United States Patent [19]

Korenyi

[11] Patent Number: 4,561,841

[45] Date of Patent: Dec. 31, 1985

[54] COMBUSTION APPARATUS

[76] Inventor: Donald Korenyi, 25 John St., Lynbrook, N.Y. 11563

[21] Appl. No.: 624,887

[22] Filed: Jun. 27, 1984

Related U.S. Application Data

[63] Continuation-in-part of Ser. No. 523,810, Aug. 16, 1983, Pat. No. 4,464,108, which is a continuation-in-part of Ser. No. 208,887, Nov. 21, 1980, abandoned.

[51] Int. Cl.[4] ..... F23Q 3/00

[52] U.S. Cl. ..... 431/265; 431/183; 431/351; 239/402

[58] Field of Search ..... 431/265, 351, 183, 185; 239/402

[56] References Cited

U.S. PATENT DOCUMENTS

| | | | |
|---|---|---|---|
| 1,235,855 | 8/1917 | Stillman | 239/402 |
| 2,497,480 | 2/1950 | Walshin | 239/402 |
| 2,647,568 | 8/1953 | Sloan | 431/183 |
| 3,694,135 | 9/1972 | Dancy et al. | 431/183 X |
| 4,082,495 | 4/1978 | Lefebvre | 431/183 |

*Primary Examiner*—Randall L. Green
*Attorney, Agent, or Firm*—Paul J. Sutton

[57] ABSTRACT

A combination apparatus having a swirl chamber for mixing primary air and atomized fuel in a primary helical flame vortex and a splitting chamber downstream of the swirl chamber for shearing off secondary helical flame vertexes from the primary vortex rotatably meshed with the prime vortex. Cutting blades positioned in the splitting chamber slice outer portions of the helical primary vortex into channels formed between the blades. The blades are longitudinally disposed perpendicular to the movement of the primary flame vortex and are tilted toward the primary flame vortex at an increasing angle relative to the longitudinal axis between the upstream and downstream portions of the splitting chamber. An intermediate stabilizing chamber can be positioned between the upstream swirl chamber and the downstream splitting chamber.

19 Claims, 16 Drawing Figures

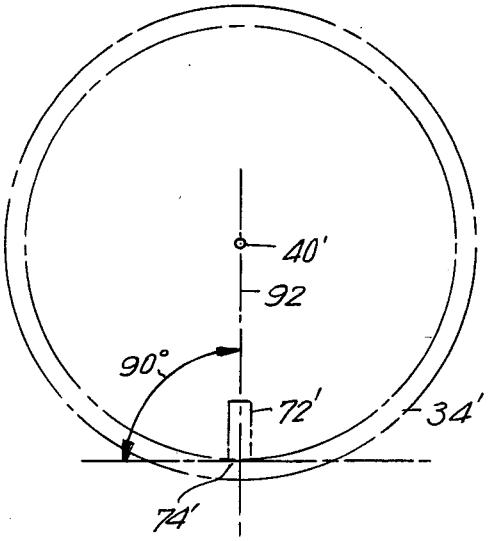
FIG. 10
FIG. 11
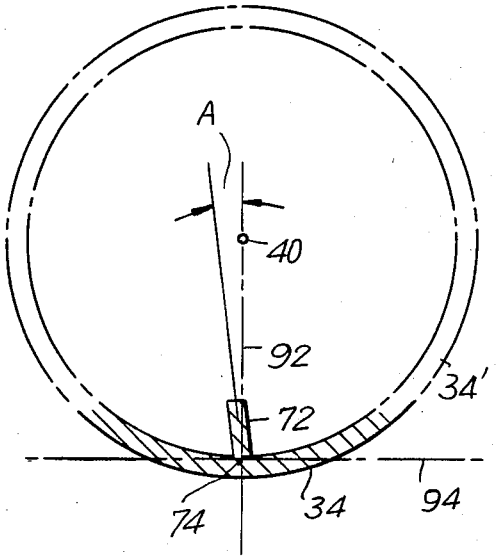
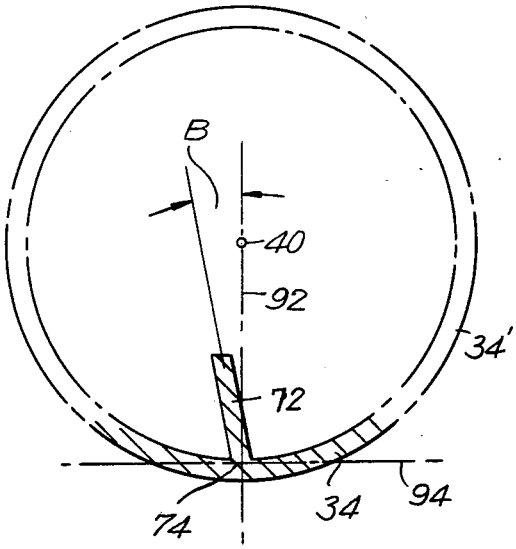
FIG. 12
FIG. 13
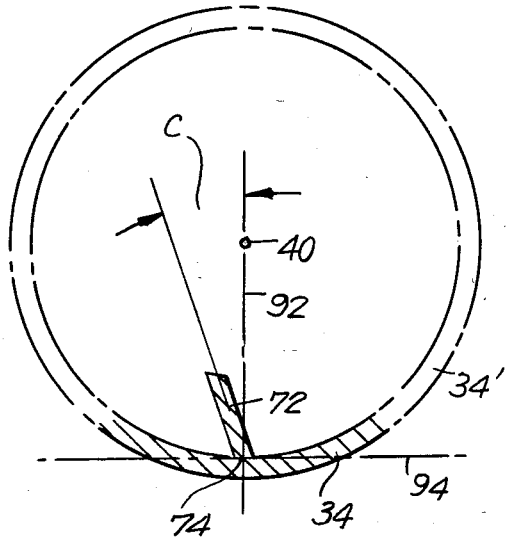

FIG. 14
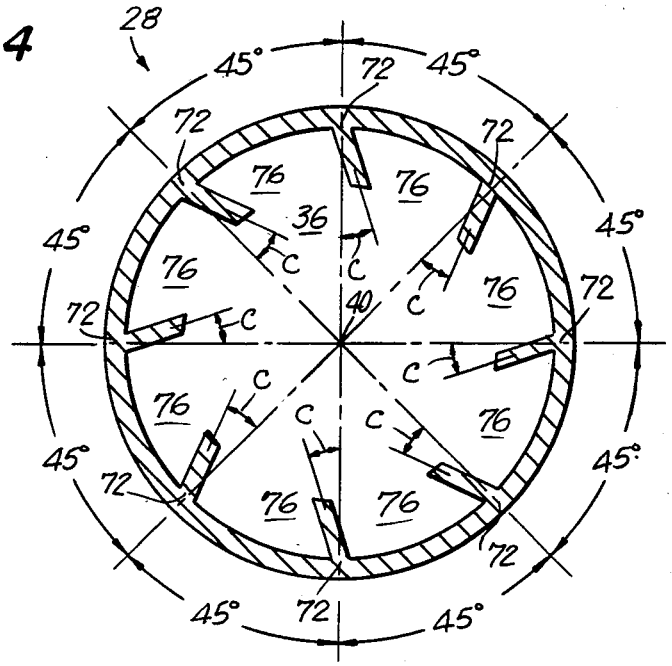
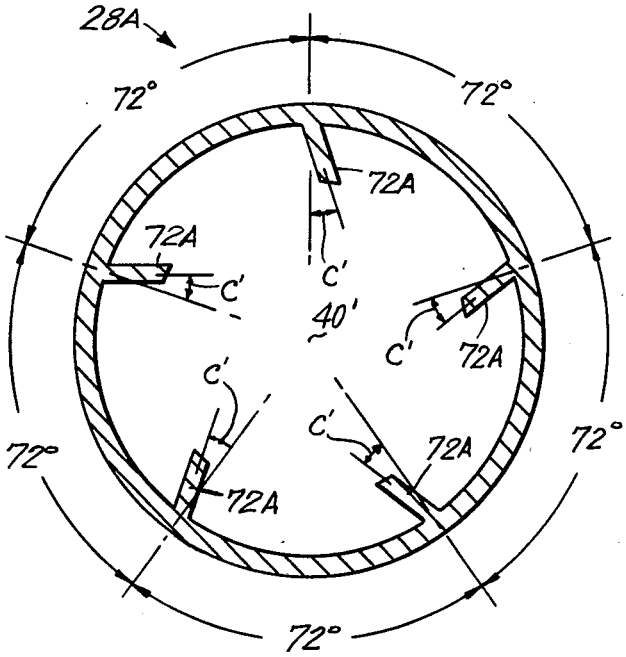
FIG. 15

COMBUSTION APPARATUS

This application is a continuation-in-part of U.S. patent application Ser. No. 523,810 filed Aug. 16, 1983 entitled Combustion Apparatus, now U.S. Pat. No. 4,464,108, which in turn is a continuation-in-part of an application filed Nov. 21, 1980, Ser. No. 208,887, now abandoned.

This invention relates generally to a combustion apparatus and, more particularly, to a combustion apparatus of the type used in domestic and commercial oil burners. The combustion apparatus can be adapted for other uses, such as jet engines.

In my prior application Ser. No. 523,810, I set forth the basic structure of a combustion apparatus that included an ignition, a source of pressurized air, and a source of pressurized atomized fuel. The apparatus included a flame retention head forming a combustion chamber having an upstream end and a downstream end and a longitudinal axis extending between the upstream and downstream ends; first passages including first deflectors capable of passing a first portion of the pressurized air and the pressurized fuel into the upstream end of the combustion chamber, the first deflectors adapted to direct the air and fuel in a first rotational direction into a fuel/air mixture of helical configuration adapted to being ignited into a primary flame vortex about the longitudinal axis; second deflectors, or vanes, mounted about the inner surface of the combination chamber downstream of the first deflectors, the second deflectors being adapted to shear away the outer portions of the primary flame vortex and direct the outer portions into a plurality of secondary flame vortexes of helical configurations directed in second rotational direction opposed to the first rotational direction and disposed about the primary flame vortex; and second passages formed in the flame retention head disposed in association with the second deflectors and being adapted to pass a second portion of the pressurized air into the combustion chamber into mixture with the plurality of the secondary flame vortexes.

I wish to more particularly set forth certain aspects of features described in my prior application. Among these features are the blades, or vanes and the cup-shaped dome member. I have found that certain angles relating to the blades, for instance, particularly efficiently create the secondary flame vortexes that characterize my invention. Also, the dome member can be adapted to create additional primary air slots that better radially direct the primary air flow. The configuration of the vanes, too, can be modified to better intercept and shear away the outer portions of the primary flame vortex. In addition, the inner wall of the portion of the chamber to which the second deflectors, or vanes, are mounted can be configured so as to more efficiently create smooth flame secondary flame vortexes. Finally, the numbers and relative disposition of the vanes, although adequately described in my prior application, might be more particularly set forth as a paradigmatic embodiment.

Before proceeding, I wish to mention that certain terms used in my prior application will be altered so as to better reflect the actual function of the parties of the system described or to better designate the feature as generally done in the art. This change in terminology is limited, and is as follows: "spin chamber" will be used to designate the chamber formed by dome member 72; the term "splitting chamber" will be used for the previously designated deflector tube 64; both being a portion of the flame retention head 54, now designated as the combustor or combustor body.

Accordingly, it is an object of the present invention to provide an improved and more efficient combustion apparatus.

It is a further object of the present invention to provide an improved combustion apparatus having vanes mounted in the combustor at designated angles so as to more efficiently shear away the outer portions of a primary flame vortex into a plurality of secondary flame vortexes.

It is yet another object of the present invention to provide an improved combustion apparatus that includes a pair of concentric dome members forming staggered air slots to direct primary air radially outwardly in the spin chamber.

It is still another object of the present invention to provide an improved combustion apparatus that more efficiently directs an air and fuel mixture into the combustor.

It is yet another object of the present invention to provide an improved combustion apparatus that more efficiently directs an air and fuel mixture into the combustor.

It is yet another object of the present invention to provide an improved combustion apparatus having an extension sleeve for the combustor head in order to improve the mixing of the fuel and air prior to entering the combustor.

It is still a further object of the present invention to provide an improved combustion apparatus that has cutting vanes that more efficiently shear away outer portions of the primary vortex.

These and other objects, features, and advantages of the invention will, in part, be pointed out with particularity and will, in part, become obvious from the following more detailed description of the invention, taken in conjunction with the accompanying drawings which form an integral part thereof.

The present invention sets forth details of certain features of my prior application Ser. No. 523,810 and also sets forth certain improvements relating to the combustion apparatus described therein.

The invention includes basic features of my prior application in which a full description of the air, fuel, and flame vortexes may be found. The present application includes these features and the whole may be summarized as follows.

The combustion apparatus, which includes an igniter, a source of pressurized air, and a source of pressurized atomized fuel, comprises the following features: A combustor body forming a generally cylindrical combustor chamber having an upstream end and a downstream end and a longitudinal axis extending between the upstream and downstream ends. The body includes an upstream end first combustor portion forming a generally dome-shaped swirl chamber and a downstream end second combustor portion having a generally cylindrical wall forming a second chamber. The first and the second chambers comprise the combustor chamber. The first combustor portion forms a series of first passages adapted to pass a first portion of the pressurized and pressurized fuel into the first chamber. The first combustor portion includes a series of deflectors, or swirl vanes, associated with the first passage adapted to direct the first portion of air and fuel in a first rotational direction into mixing into a fuel/air mixture of generally helical configuration adapted to being ignited into a primary helical flame vortex about the longitudinal axis. The combustor apparatus further includes a plurality of evenly spaced cutting blades that extend into the second chamber. The blades have bases connected to the cylindrical wall of the second chamber and form a plurality of channels therebetween. The blades are adapted to split away the outer portion of the primary flame vortex and to direct the outer portion into the plurality of secondary helical flame vortexes of generally helical configuration in the channels in a second rotational direction about the primary flame vortex. The blades are disposed approximately perpendicular to the first rotational direction of the primary flame vortex and are disposed toward the first rotational direction at an angular tilt measured from the bases of the blades at the cylindrical wall of the splitting chamber. The combustor apparatus also includes second passage means formed in associated with the cylindrical wall of the second combustor portion and with the plurality of blades; the passage means are for passing a second portion of the pressurized air into the splitting chamber into mixture with the second flame vortexes.

The blades mentioned above extend between upstream and downstream sides of the second chamber and are disposed at a progressively increasing angular tilt between a first angle at the upstream side and a second angle spaced closely from the downstream side. The first angle is preferably approximately between 6 to 8 degrees and the second angle is approximately 22½ degrees. The vanes are longitudinally disposed preferably at approximately 48 degrees relative to the longitudinal axis. The blades can be of an even or an odd number of blades.

The first combustor portion is a first convex wall having a circumferential rim generally coextensive with the cylindrical wall of the second combustor portion; the convex wall includes the series of deflectors. A second convex wall can overly the first convex wall so as to better circulate the air and fuel mixture radially in the swirl chamber.

A cylindrical sleeve member is optionally secured to a cylindrical retaining member about the combustor body. The sleeve member is radially spaced from the retaining member and is axially spaced from the downstream end of the combustor body.

My invention will be more clearly understood from the following description of specific embodiments of the invention together with the accompanying drawings, wherein similar reference characters denote similar elements throughout the several views, and in which:

FIG. 10 is a view taken through line 10—10 of FIG. 9;

FIG. 11 is a view taken through line 11—11 of FIG. 10;

FIG. 12 is a view taken through line 12—12 of FIG. 9;

FIG. 13 is a view taken through line 13—13 of FIG. 9;

FIG. 14 is a full downstream view of the splitting chamber taken through the same general area as line 13—13 of FIG. 9;

FIG. 15 is a downstream view of the splitting chamber similar to FIG. 14 showing five cutting blades.

Reference is now made in detail to the drawings.

Figure 1:
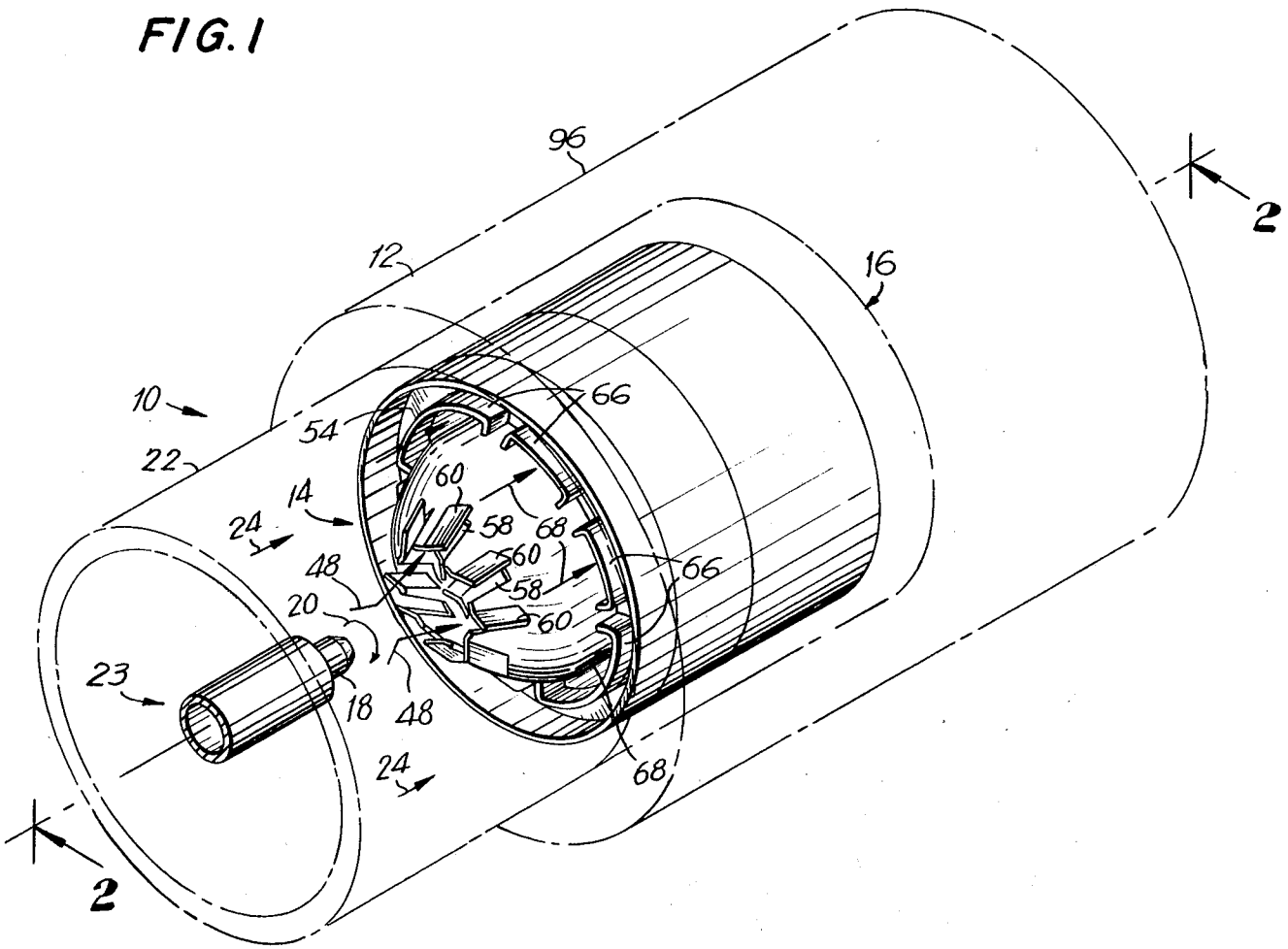
FIG. 1 is a perspective view illustrating the combustion apparatus.
Figure 2:
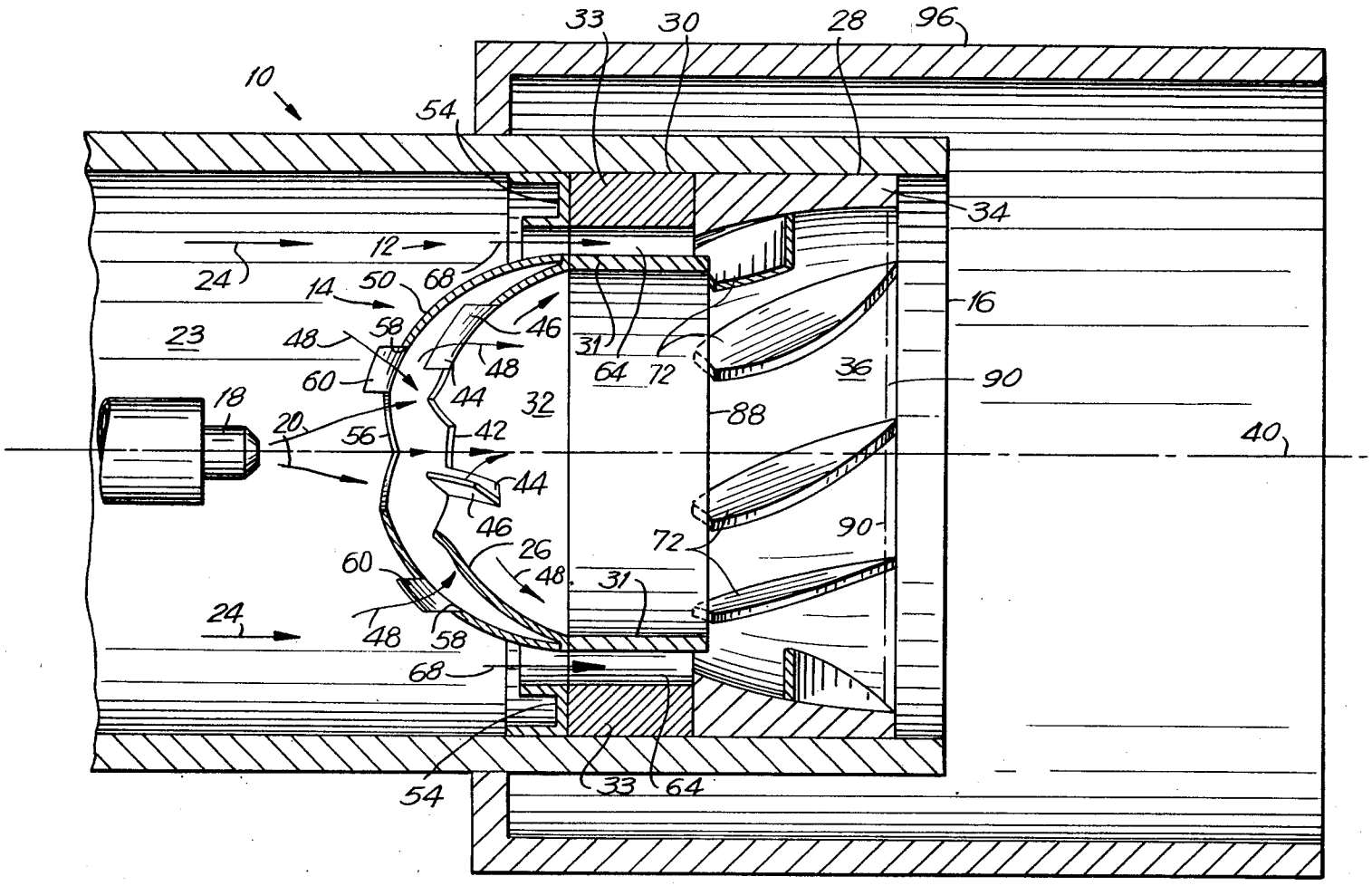
FIG. 2 is a view taken through plane 2—2 of FIG. 1.

FIG. 1 illustrates in perspective view a combustion apparatus 10 that is directed for use for a home heating boiler as one example of many possible uses for the present invention. Combustion apparatus 10 includes a combustor body 12 having an upstream end 14 and a downstream end 16, a pressurized fuel atomized liquid fuel 20 in a generally clockwise direction towards upstream end 14 of body 12. Body 12, which is shown in solid lines, is enclosed by a generally cylindrical hollow retaining member 22 made of, for example, ceramic, which is shown in phantom lines. Retaining member 22 also encloses nozzle 18 and forms a cylindrical pressurized air chamber 23 that is adapted to pass pressurized air 24 from a source of pressurized air (not shown). FIG. 2 illustrates a longitudinal sectional view of apparatus 10 including combustor body 12 and retaining member 26. The details of combustor body 12 can be seen to include upstream end 12 where a convex wall 26 that is positioned at upstream end 14 of combustor body 12 extends outwardly into pressurized air chamber 23. A shearing, or splitting, cylinder 28 of combustor body 12 is positioned at the downstream end of the combustor body. A center stabilizing cylinder 30 is positioned between convex wall 26 and combustor cylinder 28. Center cylinder 30 is, as stated, an optional feature of combustor body 12, and combustor apparatus 10 can also function without center cylinder 30.

Figure 3:
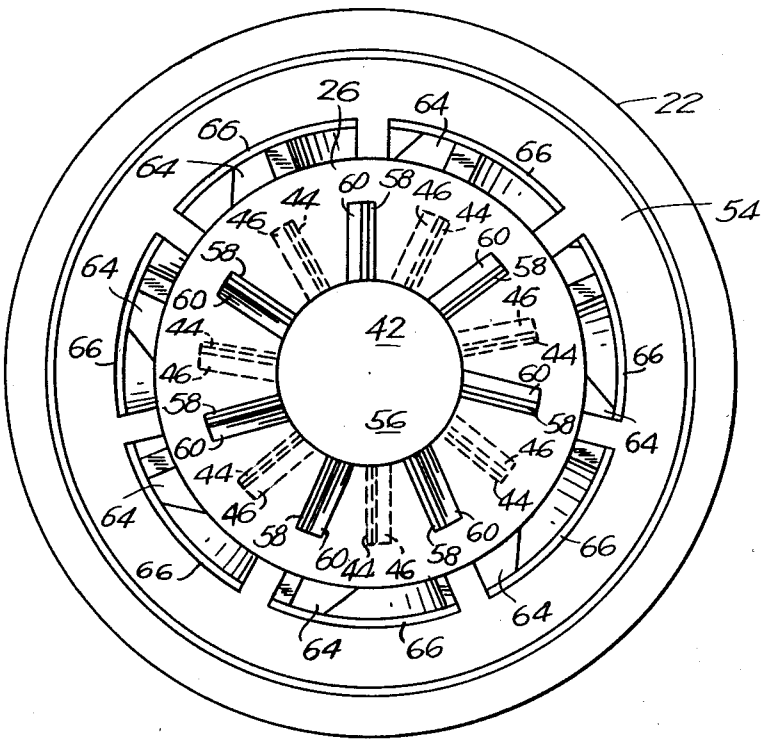
FIG. 3 is an upstream view of the convex wall of the combustion.

Convex wall 26 forms a dome-shaped swirl chamber 32, and shearing portion 28 includes a cylindrical wall 34 that forms a generally cylindrical shearing chamber 36. Center cylinder 30 forms a generally cylindrical central stabilizing chamber 38 that is coextensive with swirl and splitting chambers 32 and 36 with an imaginary single longitudinal cylindrical axis 40 extending through all three chambers 32, 36, and 38. Longitudinal axis 40 is also the longitudinal axis of pressurized air chamber 23. Spray nozzle 18 likewise is centered at axis 40 as is convex wall 26. Convex wall 26 is configured as a dome, and can be in the general shape of a hemisphere, as shown, or in the general shape of a parabaloid as is shown in schematic side view in FIG. 3 where parabaloid convex wall 26A forms parabaloidal swirl chamber 32A. In the context of this application, dome-shaped is to be considered either hemispherical or parabaloid in configuration. Convex wall 26 forms a circular central passage 42, as seen most clearly in FIG. 13, and a series of radiating passages, or slots, 44 emanating from central passage 42. Seven radiating slots 44 are shown as dotted lines in FIG. 4; the number of radiating slots 44 can vary and the seven shown are by way of example only. Each slot 44 has extending form one of its edges a tab, or swirl vane, 46 that is adapted to direct a portion of pressurized air 24 in a counterclockwise rotation as viewed from upstream into swirl chamber 32. That is, tabs 46 are on the far radiating edges of slots relative to a counterclockwise motion and are tilted so as to direct pressurized air 24 into swirl chamber 32. Atomized fuel 20 enters swirl chamber 32 through central passage 42 while rotating in a clockwise direction as viewed from upstream. Pressurized air 24 that is directed into swirl chamber 32 is shown by primary air arrows 48.

Figure 4:
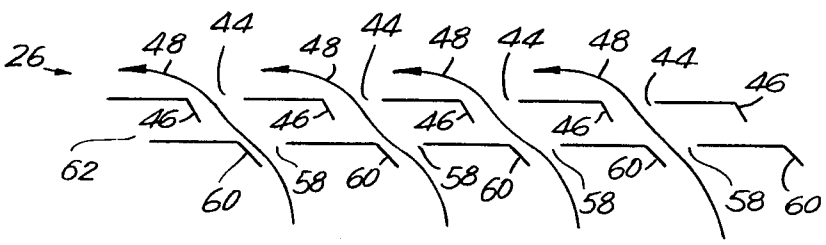
FIG. 4 is a schematic view of the inner and outer convex walls of the combustion.
Figure 5:
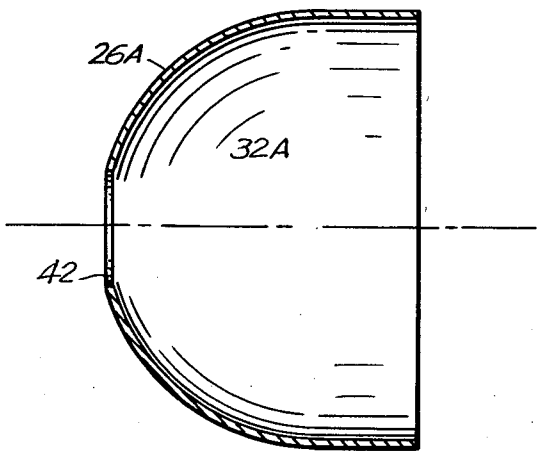
FIG. 5 is an optional schematic view of a parabaloid configuration of the convex wall.

As shown in FIGS. 2 and 4, an optional outer second convex wall 50 is spaced outwardly from convex wall 26, which becomes the inner wall, into pressurized air chamber 23. Outer convex wall 50 includes a circular downstream rim 52 that is joined to center cylinder 30 by connection to a radially inwardly extending flange portion 54 that is in turn connected to center cylinder 30. Outer convex wall 50 is configured as a dome that generally follows the configuration of inner convex wall 26; when inner convex wall 26 is configured as a hemisphere, outer convex wall 50 follows a hemispherical configuration as closely as possible, and when inner convex wall 26 is configured as a parabaloid, outer convex wall 56 follows the same parabaloidal configuration as closely as possible. Outer convex wall 50 is connected to flange 54 and to inner convex wall 26 at rim 52. Outer convex wall 50 forms a central circular central passage 56 that is of the same size as circular central passage 42 of inner convex wall 26. Outer convex wall 50 also forms a series or radiating slots 58 emanating from central passage 56. Seven slots 58 are shown each positioned between slots 44 of inner convex wall 26. Each slot 58 has extending from one of its edges a tab, or swirl vane, 60 that is adapted to direct primary air 48 in a downstream counterclockwise direction as viewed from upstream into the curved space 62 formed between inner and outer convex walls 26 and 50. Central passage 56 passes most of atomized fuel 20 into space 62 and also passes a portion of primary air 48 into space 62. A flattened, schematic rendering of the movement of primary air 48 and atomized fuel 20 is shown in FIG. 5. For purposes of exposition, the movement is isolated as primary air arrows 48 first entering slots 58 and being slanted radially outwardly in space 62 until being directed by swirl vanes 46 of inner convex wall portion 50 through slots 44 into swirl chamber 32. The second direction by swirl vanes 46 increases the tendency of primary air 48 to move radially outwardly in swirl chamber 32 and thus to increase the mixing between primary air 48 and atomized fuel 20 into a combustible fuel/air mixture about axis 40.

Flange 54 forms seven arcuate slots 64 between pressurized air chamber 23 and stabilizing chamber 38. Directing tabs 66 associated with arcuate slots 64 connected to flange 54 direct portions of pressurized air 24 designated as secondary air arrows 68 through slots 64 into stabilizing chamber 32 where the secondary air is mixed with the periphery of the fuel/air mixture now ignited (initially by ignition means not shown) into a primary flame vortex 70 of generally helical configuration, which is best seen in FIG. 8.

Figure 6:
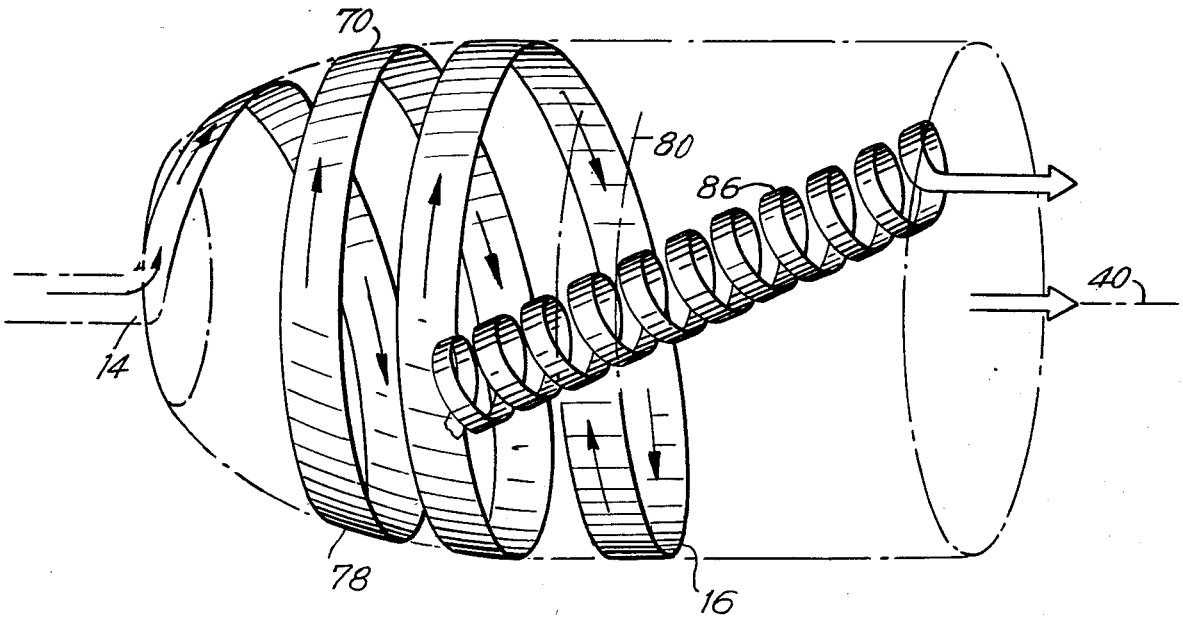
FIG. 6 is a perspective view illustrating the primary and secondary flame vortexes in the combustor.
Figure 7:
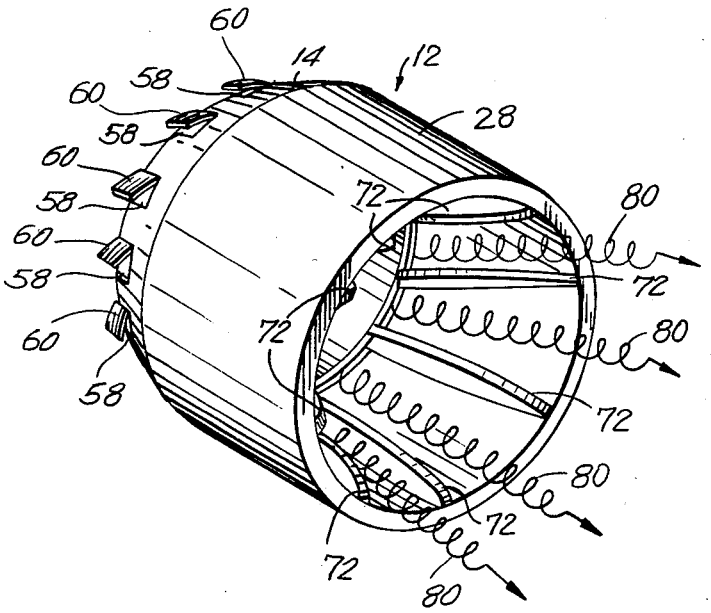
FIG. 7 is a perspective view of the combustor from upstream.

As seen in FIGS. 2, 7, and 14, parallel evenly spaced vanes, or blades, 72 extend into splitting chamber 36. As shown in the preferred embodiment, eight blades 72 are shown, although, as will be discussed, this number may vary; as one example shown in FIG. 15, the number of blades, shown as blades 72A, can be five. Each blade 72 has a base 74 connected to the inner surface of cylindrical wall 28 of splitting chamber 36. Eight channels 76 are formed by blades 72, each channel being defined by the inner surface of wall 28 and blades 72. Blades 72 are adapted to shear, or split, away the outer portion 78 of primary helical flame vortex 70, shown in FIG. 6, to direct sliced outer portion 78 to form eight secondary flame vortexes 80 each of generally helical configuration from primary vortex 70. Secondary vortexes 80 are directed by blades 72 to rotate in channels 76 and to move in a rotational direction opposite to primary vortex 70, that is, in a clockwise direction looking downstream. FIG. 8 illustrates primary vortex 70 and secondary vortexes 80 viewed from an upstream position. Both primary and secondary flame vortexes 70 and 80, move as a mass longitudinally downstream in combustor body 12. Secondary vortexes 80 move in a manner analagous to planetary gearing about primary vortex 70. Eight inner and eight outer minor flame vertexes 84 and 86 are formed in the spaces between primary and secondary vertexes 70 and 80 and between secondary vertexes 80 and cylindrical wall 34 of splitting chamber 36 respectively; minor vortexes 84 and 86 mesh in a planetary gear configuration with primary vortex 82 and secondary vortexes 80. Blades 72 are disposed approximately perpendicular to the rotational direction of primary flame vortex 70. Vanes 72 are longitudinally disposed preferably at approximately 48 degrees relative to longitudinal axis 40. This angle, shown as angle X in FIG. 9, could vary from 48 degrees.

Figure 8:
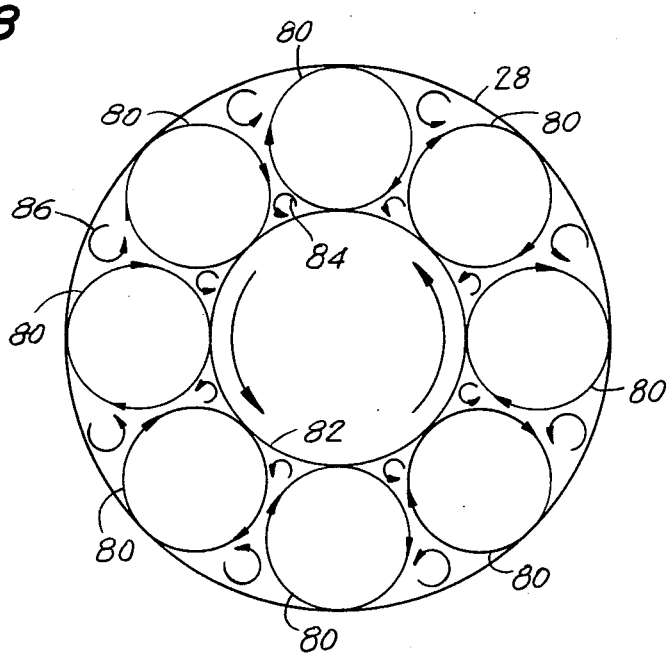
FIG. 8 is a downstream view of the primary, secondary and peripheral inner and outer flame vortexes.

It is to be particularly noted, and as inicated in FIGS. 6 and 8, that secondary vertexes 80 are first formed in channels 76 of splitting cylinder 28 and then, once formed, continue relatively intact part downstream end 16 of combustor 12. Primary vortex 70 has a diameter preferably approximately between $2\frac{1}{2}$ to 3 times greater than the diameters of secondary vortexes 80.

Blades 72 are disposed toward the first rotational direction of primary flame vortex 70 at an angular tilt measured from bases 74 of the blades relative to the radii of cylindrical wall 34 is known as 34, in phantom lines for a reconstructed portion, of splitting chamber 36. The radii comprise the radii taken at any cross-section taken of splitting chamber 36 taken perpendicular to longitudinal axis 40 as shown in FIGS. 9–13, which illustrate a typical blade 72 in fragmented isolation and in perpendicular cross-section to axis 40 taken at upstream side 88 of splitting chamber 36 (FIG. 11), a point taken spaced closely from downstream side 90 of splitting chamber 36 (FIG. 13), and a random point taken along splitting chamber 36 between the sections of FIGS. 11 and 13 typified by the cross-section shown in FIG. 12. Downstream side 90 is coextensive with downstream end 16 of combustor body 12. As shown in FIGS. 11, 12, and 13, the angular tilt of each blade 72 increases from an initial angle A disposed at upstream side 88 shown in FIG. 11 through a continuous progressive angular tilt typified by angle B in FIG. 12 to a final angle C at the disposition shown in FIG. 13 spaced from downstream side 90. Blades 72 preferably cease further increase of the angular tilt shown in FIGS. 11–13 a short distance from downstream end 16 at which point the tops the blades begin a relatively steep decline to the surface of cylindrical wall 34. This decline preferably is at the final angle C shown in FIG. 13.

Angle A shown in FIG. 11 is the measurement of blade 72 tilted approximately 6 to 8 degrees relative to the radius 92 of cylindrical wall 34 measured to the tangent 94 at base 74 of blade 72 at the perpendicular section relative to axis 40. The remainder of cylindrical wall 34 other than the sectional fragment is shown in phantom lines, a procedure also followed for FIGS. 12 and 13.

Angle C shown in FIG. 13 is the measurement of blade 72 tilted approximately 22½ degrees relative to radius 92 of cylindrical wall 34 measured to the tangent 94 at base 74 of blade 72 at the perpendicular section relative to axis 40.

Angle B shown in FIG. 12 represents the measurement of blade 72 at any angle between angle A and angle C relative to radius 92 of cylindrical wall 34 measured to tangent 94 at base 74 of blade 72 at any perpendicular section relative to axis 40 between the sections shown in FIGS. 11 and 13. Angle B is directly proportioned to the distance at which section 12—12 is measured relative to the sections of FIGS. 11 and 13.

Figure 9:
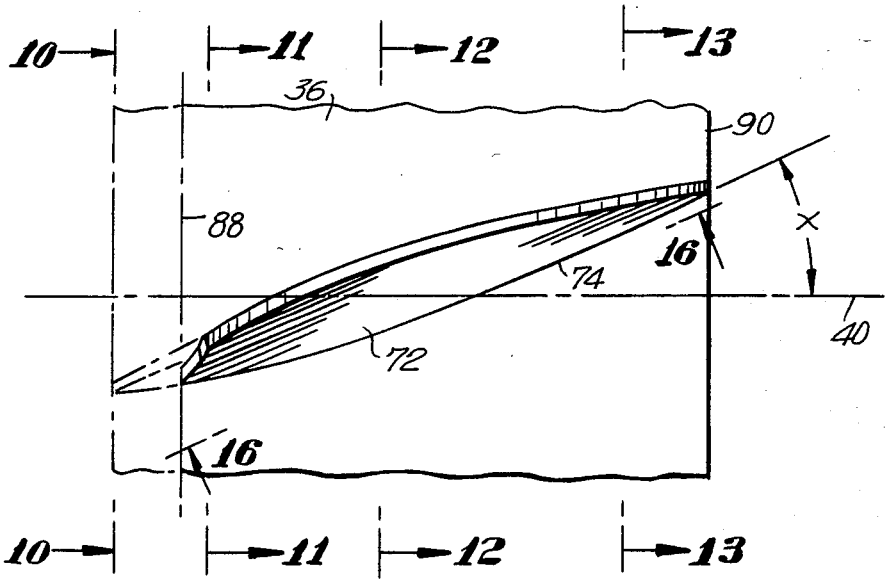
FIG. 9 is a view looking down on a fragment of the splitting chamber showing a single cutting blade.

FIG. 10 represents a hypothetical orientation of a zero inclination of an imaginary blade 72, relative to the radius measured to imaginary base 74, the imaginary portions shown in phantom lines. As seen in FIG. 9, FIG. 10 represents a perpendicular section taken of combustor body 12 taken upstream of splitting chamber 36.

FIG. 14 illustrates a vertical full sectional view of splitting chamber 36 similar to the section shown in FIG. 13 with downstream angle C shown. The bases 74 of the eight blades 72 are disposed diametrically across, that is, oppositely positioned, from one another with the angular distance between the adjoining bases 74 being at 45 degrees or ⅛ of the circumference of the inner surface of cylindrical wall 34. Eight channels 76 are shown formed between blades 72 as previously described.

In my prior application Ser. No. 523,810 I described a plurality of flow paths and showed by way of example seven secondary flame vortexes in certain embodiments. The embodiment of this application could likewise employ seven vortexes with the proviso that the blades are circumferentially equally disposed. Likewise, especially for a combustor body of relatively small diameter with a splitting portion 28A, five blades 72A forming five channels 76A with the blades disposed at 72° forming five vortexes at angular intervals as shown in FIG. 15, which is sectionally analagous to FIG. 14, could be used.

Stabilizing chamber 38 described previously is an optional feature and is not necessary to the operation of the combustion apparatus being described here. As noted before, stabilizing chamber 38 has the capacity to provide an interim space for further mixing and generally stabilizing th helical movement of primary flame vortex 70.

Figure 16:
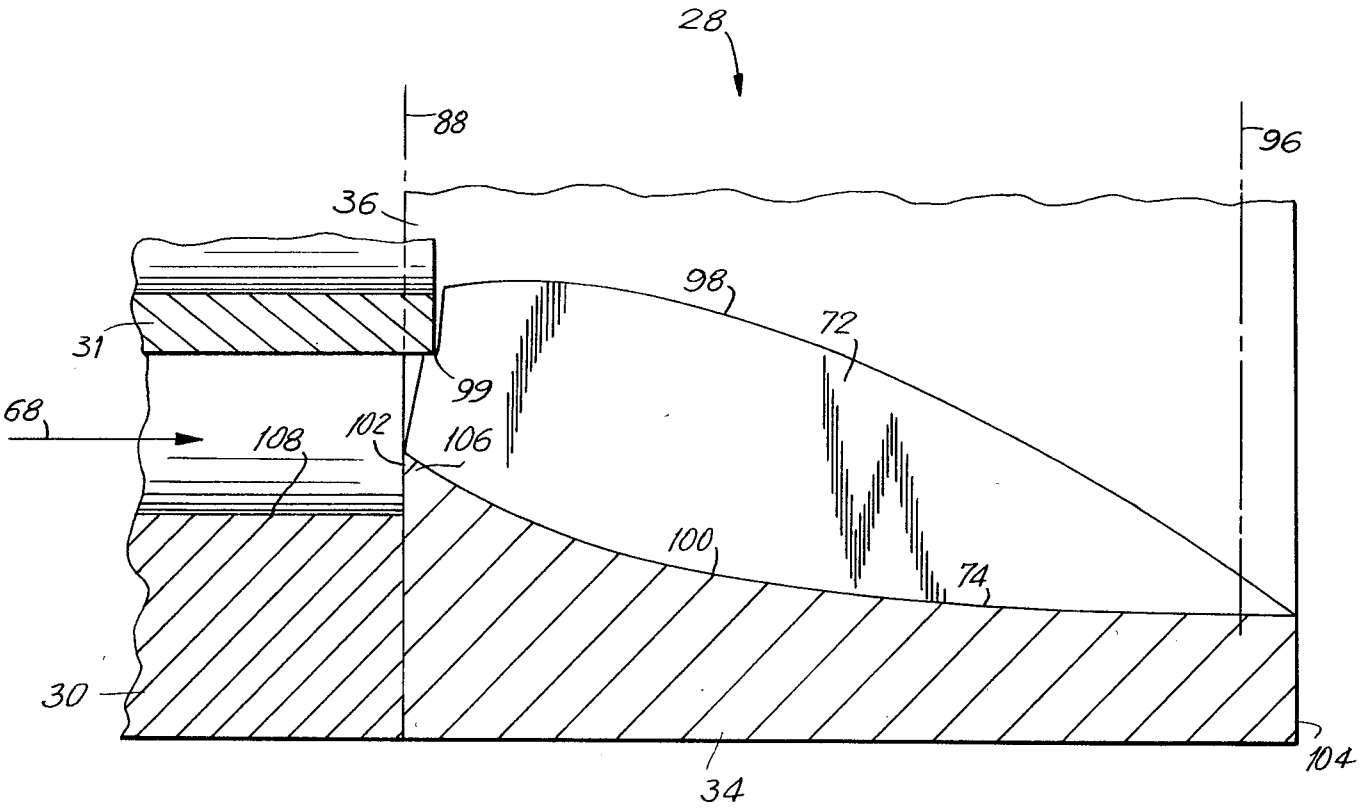
FIG. 16 is a view of a single blade taken through line 16—16 of FIG. 9.

As seen in FIG. 2, stabilizing cylinder 30 includes a cylindrical inner wall 31 that is connected to rim 52 of convex wall 26. Stabilizing cylinder 30 also includes an outer wall 33 having cylindrical inner surface 108. As seen in FIG. 16 inner wall 31 extends slightly into splitting chamber 36.

As seen in FIGS. 1 and 2, a generally cylindrical sleeve member 96, preferably made of a ceramic material, is secured to and radially spaced from cylindrical retaining member 22 and axially spaced from said downstream end 16 of combustor body 12. As noted previously, secondary vortexes 80 continue relatively intact past downstream end 16 of combustor 12 as does pimary vortex 70. Sleeve member 96 is adapted to continue these vortexes and their meshing action longer them they would otherwise.

FIG. 16 illustrates in a fragmented elevational view of single blade 72 having a top edge 98 that curves upwardly into splitting chamber 36. Top edge 98 can be manufactured so as to be selectively configured inwardly in splitting chamber 36 so as to shear away selected portions of primary flame vortex 70 into secondary flame vortexes 80. Within limits, the more or less each top edge 98 is configured inwardly into the splitting chamber the greater or lesser, respectively, are the densities and sizes of secondary vortexes 80.

As seen in FIG. 16, the inner surface 100 of cylindrical wall 34 of splitting cylinder 28 forms a generally circular upstream rim 102 and a generally circular downstream rim 104 coextensive with upstream and downstream sides 88 and 90 respectively of splitting chamber 36. Upstream rim 102 is of larger diameter than downstream rim 104. Inner surface 100 gradually slopes outwardly relative to axis 40 of combustor body 12 between upstream and downstream rims 102 and 104. FIG. 16 includes a fragment of the cylindrical wall of stabilizing cylinder 30 illustrating a preferred slight radial projection 106 of top edge 98 of blade 72 beyond the inner surface 108 of stabilizing portion 30. In addition, top edge 98 forms slight step 99 to accommodate inner wall 31 of of stabilizing cylinder 30.

It is to be noted that in my previous application Ser. No. 523,810, I described a tertiary air intake into the combustor downstream of the entry of the secondary air. This feature can easily be added to the embodiment of the present invention shown herein.

There has been disclosed herebefore the best embodiments of the invention presently contemplated. It is to be understood, however, that various changes and modification may be made by these skilled in the art without departing from the spirit of the invention.

What is claimed is:

1. A combustion apparatus including ignition means, a source of pressurized air, and a source of pressurized atomized fuel, said apparatus comprising, in combination:

a combustor body forming a generally cylindrical combustor chamber having an upstream end and a downstream end and a longitudinal axis extending between said upstream and downstream ends, said body including an upstream end first combustor portion forming a generally dome-shaped first chamber and a downstream end second combustor portion having a generally cylindrical wall forming a second chamber, said first chamber and said second chamber comprising said combustor chamber, said first combustor portion forming first passage means for passing a first portion of said pressurized air and said pressurized fuel into said said first chamber, said first combustor portion including deflector means associated with said first passage means for directing said first portion of said air in a first rotational direction into a fuel/air mixture of generally helical configuration adapted to being ignited into a helical primary flame vortex about said longitudinal axis, a plurality of approximately parallel evenly spaced blades extending into said second chamber, said blades having bases connected to said cylindrical wall of said second chamber and forming a plurality of channels therebetween, said blades being adapted to split away the outer portion of said primary flame vortex and to direct said outer portion into a plurality of secondary flame vortexes of generally helical configuration in said channels in a second rotational direction about said primary flame vortex, said blades being disposed approximately perpendicular to said first rotational direction of said primary flame vortex and disposed toward said first rotational direction at an angular tilt measured from said bases of said blades relative to radii extending to a tangential plane at said bases of said blades at said cylindrical wall of said second chamber, and second passage means formed in association with said cylindrical wall of said second combustor portion and with said plurality of blades and being for passing a second portion of said pressurized air into said second chamber into mixture with said plurality said secondary flame vortexes.

2. The combustion apparatus according to claim 1, wherein said second chamber has an upstream side and a downstream side coextensive with said downstream end of said combustor chamber, said blades being disposed between said upstream and downstream sides, said angular tilt progressively increasing between a first angle disposed at said upstream side and a second angle spaced closely from said downstream side.

3. The combustion apparatus according to claim 2, wherein said first angle is approximately between 6 to 8 degrees and said second angle is approximately 22½ degrees.

4. The combustion apparatus according to claim 3, wherein said plurality of vanes are disposed at longitudinally approximately 45 degrees relative to said longitudinal axis.

5. The combustion apparatus according to claim 3, wherein said plurality of vanes is an even number of vanes with said even number of vanes disposed in oppositely positioned pairs.

6. The combustion apparatus to claim 5, wherein said even number of vanes is eight.

7. The combustion apparatus according to claim 3, wherein said plurality of vanes is an odd number of vanes.

8. The combustion apparatus according to claim 1, wherein said first combustor portion is a convex wall having a circumferential rim generally coextensive with said cylindrical wall of said second combustor portion said convex wall including said deflector means.

9. The combustion apparatus according to claim 8, wherein said convex wall is configured as a hemisphere.

10. The combustion apparatus according to claim 8, wherein said convex wall is configured as a parabaloid.

11. The combustion apparatus according to claim 8, wherein said convex wall is a first convex wall, said circumferential rim is a first circumferential rim, and said deflector means is first deflector means, said apparatus further including a second convex wall having a second circumferential rim coextensive with said first circumferential rim, said second convex wall being spaced outwardly from said first convex wall and including second deflector means equally staggered relative to said first deflection means, said second deflector means being for further radially directing said primary air and said fuel in said dome-shaped chamber about said longitudinal axis.

12. The combustion apparatus according to claim 11, wherein said first and second convex walls are configured as hemispheres.

13. The combustor apparatus according to claim 11, wherein said first and second convex walls are configured as paraboloids.

14. The combustion apparatus according to claim 1, wherein said combustor body further forms a generally cylindrical third chamber positioned between and integral with said first and second chambers, said third chamber being capable of further mixing and generally stabilizing the helical movement of said primary flame vortex, said first, second, and third chambers comprising said combustor chamber.

15. The combustion apparatus according to claim 1, further including a cylindrical retaining member secured to said combustor body and extending upstream of said combustor body defining with said first portion a fourth chamber adapted to contain said pressurized air and said pressurized atomized fuel.

16. The combustion apparatus according to claim 15, further including a generally cylindrical sleeve member secured to and radially spaced from said cylindrical retaining member and axially spaced from said downstream end of said combustor body.

17. The combustion apparatus according to claim 1, wherein said plurality of blades have top edges, said top edges being selectively configured inwardly in said second chamber and adapted to shear away selected portions of said primary flame vortex into said plurality of secondary flame vortexes.

18. The combustion apparatus according to claim 17, wherein said cylindrical wall of said second chamber includes an inner surface, said inner surface forming a generally circular upstream side rim and a generally circular downstream side rim having a larger diameter that said upstream side rim, said inner surface gradually sloping outwardly from said upstream side rim to said downstream side rim.

19. The combustion apparatus according to claim 18, wherein said third chamber is defined by a cylindrical wall having an inner surface, said top edges of said blades having a slight radial projecting portion beyond said inner surface of said cylindrical wall of said third chamber.

* * * * *